US008695115B2

(12) United States Patent
Leyva

(10) Patent No.: US 8,695,115 B2
(45) Date of Patent: Apr. 15, 2014

(54) FIGURE MOULDING AND WEIGHT LOSS AID SYSTEMS AND METHODS

(76) Inventor: Jacqueline Leyva, Leon Valley, TX (US)

( * ) Notice: Subject to any disclaimer, the term of this patent is extended or adjusted under 35 U.S.C. 154(b) by 148 days.

(21) Appl. No.: 13/079,935

(22) Filed: Apr. 5, 2011

(65) Prior Publication Data

US 2012/0255098 A1 Oct. 11, 2012

(51) Int. Cl.
*A41D 1/00* (2006.01)
*A41C 1/04* (2006.01)

(52) U.S. Cl.
USPC ..... 2/69; 2/109; 450/97; 450/143

(58) Field of Classification Search
USPC ..... 2/69, 78.1, 78.3, 109, 110, 113, 228, 2/238, 400, 401, 73, 92, 255, 256, 258, 2/260, 406, 456, 458; 450/97, 132, 7, 8, 450/23, 143, 146, 114, 115, 122, 131; 482/124, 105; 604/312
See application file for complete search history.

(56) References Cited

U.S. PATENT DOCUMENTS

| | | | | | |
|---|---|---|---|---|---|
| 1,020,825 | A | * | 3/1912 | Jacbos | 450/97 |
| 1,274,457 | A | * | 8/1918 | Schneck | 450/97 |
| 1,478,095 | A | * | 12/1923 | Bender | 450/97 |
| 1,499,265 | A | * | 6/1924 | Ullman et al. | 450/97 |
| 1,499,564 | A | * | 7/1924 | Ullman et al. | 450/97 |
| 1,632,017 | A | * | 6/1927 | Work et al. | 450/153 |
| 1,667,989 | A | * | 5/1928 | Rocke | 450/121 |
| 1,999,792 | A | | 4/1935 | Taylor | |
| 2,261,547 | A | * | 11/1941 | Goodman et al. | 450/109 |
| 2,393,612 | A | * | 1/1946 | Bullinger | 450/132 |
| 2,462,996 | A | * | 3/1949 | Root et al. | 450/132 |
| 2,708,271 | A | | 5/1955 | Steinberg | |
| 2,782,414 | A | * | 2/1957 | Goldstein | 450/118 |
| 3,149,634 | A | * | 9/1964 | Martin | 450/17 |
| 3,310,052 | A | | 3/1967 | Ward | |
| 3,441,027 | A | * | 4/1969 | Lehman | 450/154 |
| 3,759,510 | A | | 9/1973 | Jackson, Jr. | |
| 4,287,893 | A | * | 9/1981 | Salazar | 450/132 |
| 4,946,453 | A | | 8/1990 | Monson | |
| 5,196,240 | A | | 3/1993 | Stockwell | |
| 5,282,277 | A | | 2/1994 | Onozawa | |
| 5,537,690 | A | * | 7/1996 | Johnson | 2/44 |
| 5,700,231 | A | | 12/1997 | Wilkinson | |
| 5,733,626 | A | | 3/1998 | Middleton | |
| 6,049,908 | A | | 4/2000 | Bullock et al. | |

(Continued)

FOREIGN PATENT DOCUMENTS

| | | | |
|---|---|---|---|
| GB | 2305603 | A | 4/1997 |
| JP | 2009228149 | A | 10/2009 |
| WO | WO0044346 | A | 8/2000 |

*Primary Examiner* — Amy Vanatta
(74) *Attorney, Agent, or Firm* — The Law Firm of H. Dale Langley, Jr., P.C.

(57) ABSTRACT

A garment for wear by a human body having a localized fat accumulation includes an insulative and perspiration impermeable panel sized to conform to the localized fat accumulation. The garment also includes a supportive cover connected to the panel for retaining the panel in contact to the localized fat accumulation during wear, and a boning segment connected to the panel for supporting and shaping the body during wear. The garment may be in the form of a kit further including a wipe containing an absorbed anticellulite agent. The wipe spreads the anticellulite agent on the body where contacted by the panel during wear.

8 Claims, 9 Drawing Sheets

(56) References Cited

U.S. PATENT DOCUMENTS

| | | | | |
|---|---|---|---|---|
| 6,665,882 | B1 | 12/2003 | Pedrick | |
| 2003/0106129 | A1 | 6/2003 | Kim | |
| 2005/0034205 | A1 * | 2/2005 | Green | 2/69 |
| 2005/0177920 | A1 | 8/2005 | Wilkinson | |
| 2005/0187071 | A1 | 8/2005 | Yamashita et al. | |
| 2007/0043109 | A1 | 2/2007 | Linter et al. | |
| 2008/0287036 | A1 | 11/2008 | McGuire | |
| 2010/0011481 | A1 | 1/2010 | Kipnes | |
| 2010/0015190 | A1 | 1/2010 | Hassler | |
| 2010/0031414 | A1 | 2/2010 | Millet | |
| 2010/0064409 | A1 | 3/2010 | Buckley | |

* cited by examiner

FIGURE MOULDING AND WEIGHT LOSS AID SYSTEMS AND METHODS

TECHNICAL FIELD

The present invention generally relates to garments, and more particularly relates to exercise and figure slimming clothes and methods of wear and use in workout and weight loss regimen.

BACKGROUND

Figure moulding garments have been worn by people for years typically as foundation undergarments, such as corsets, brassieres, belts, and the like, which bind, compress, pull, retain, and tightly fit to shape and support specific features of the human torso. Such moulding garments have served aesthetic or medical purposes. These garments may include lacing, bows and other decorative appointments as has particularly been the case in aesthetic use. In the case of medical use, the garments may include structures, quilting, or other reinforcement for select supportive function.

Weight loss is a constant effort and objective for many people. Because of this, a number of products, ranging from pills, exercise machines, and electrical and mechanical movement devices, to publications on nutrition, diets and exercise regimens, among others, have been offered as solutions to consumers seeking to lose weight. The products have often not provided satisfactory weight loss results. It is generally believed that sweating causing water loss can lead to weight loss, if only temporarily. It is also generally believed that exercise and other forms of exertion can lead to weight loss. Certain apparel products have sought to provide certain moulding or concealment advantages. These products have not been widely accepted, however, because they are not perceived as effective, wearer issues, such as skin contact reactions, discomfort, bulky fit, awkward or ungainly appearance, and other limitations and disadvantages.

Fat deposits are often distributed somewhat differently in human males and females. Body fat often accumulates in males around the waist and abdomen. In females, body fat generally accumulates in the buttocks, hips, thighs and belly, as well as sometimes in the undersides of upper arms. Of course, fat may accumulate in a variety of locations of the body, as the foregoing are merely generalizations. Because fat deposit accumulations are localized in the body, certain weight loss efforts, such as particular types of exercise (e.g., leg, thigh, waist, etc.), can be directed to specific body parts to reduce deposits in the location. Clothing designs have generally sought primarily to hide or divert attention from fat areas of the body, rather to aid weight loss in particular fat areas.

It would therefore be desirable to provide new and improved systems and methods for figure moulding and to aid weight loss. These systems and methods would be particularly desirable if able to overcome conventional shortcomings, including lack of effectiveness and wearer issues of skin contact reactions, discomfort, bulky fit, and awkward or ungainly aesthetic appearance. Even more, inducements to encourage wear and use of the systems and methods, such as attractive appearance and comfort, would be beneficial. It would also be desirable in these systems and methods to aid weight loss through increased sweat, heat and consequent breakdown of fat tissue in particular locations where accumulated in the body.

SUMMARY

An embodiment of the invention is a garment for wear by a human body having a localized fat accumulation. The garment includes an insulative and perspiration impermeable panel sized to conform to the localized fat accumulation, a supportive cover connected to the panel for retaining the panel in contact to the localized fat accumulation during wear, and a boning segment connected to the panel for supporting and shaping the body during wear.

Another embodiment of the invention is a garment for wear by a human body during exercise. The garment includes an operative portion of neoprene layer, wrappingly contacting the abdomen below the breasts and extending to at least the pubic bone of the body and the back below the shoulder blades and extending to at least the base of the buttocks of the body during wear, a supportive portion connected to the operative portion, draping shoulders of the body during wear to selectively retain the operative portion contacting the body, and at least one boning segment connected to the operative portion, each of the at least one boning segment extending from either below the breasts to at least the pubic bone of the body in conjunction with the operative portion, and/or below the shoulder blades to at least the buttocks of the body in conjunction with the operative portion.

Yet another embodiment of the invention is a garment for wear on a human body during exercise. The garment includes a body cover for covering at least a portion of the body in retention to the body during wear and a neoprene liner connected to at least a portion of the body cover. The neoprene liner selectively directly contacts the body during wear of the body cover and the neoprene line in combination and retains perspiration and heat of the body where contacted by the neoprene liner. The body cover dissipates perspiration and heat of the body where not connected to the neoprene liner.

Another embodiment of the invention is a corset for wear by a human body. The corset includes a neoprene tube sized to wrap the body, in contact around the lower torso of the body, at least one boning segment connected to the neoprene tube extending longitudinally along the neoprene tube, and a strap connected to the neoprene tube, sized to retain the neoprene tube suspended in contact with lower torso of the body.

Yet another embodiment of the invention is a kit for exercising a human body. The kit includes a neoprene tube sized to wrap the body, in contact around the lower torso of the body, at least one boning segment connected to the neoprene tube extending longitudinally along the neoprene tube, a strap connected to the neoprene tube, sized to retain the neoprene tube suspended in contact with lower torso of the body, and a wipe containing an absorbed anticellulite agent, for spreading the anticellulite agent on the body where contacted by the neoprene tube.

Another embodiment of the invention is a kit for wear by a human body during exercise. The kit includes a body cover for covering at least a portion of the body in retention to the body during wear, a neoprene liner connected to at least a portion of the body cover, the neoprene liner selectively directly contacts the body during wear of the body cover and the neoprene liner in combination, and a wipe containing an absorbed anticellulite agent, for spreading the anticellulite agent on the body where contacted by the neoprene liner during wear. The neoprene liner retains perspiration and heat of the body where contacted by the neoprene liner. The body cover dissipates perspiration and heat of the body where not connected to the neoprene liner. The anticellulite agent acts on the body where contacted by the neoprene liner.

Yet another embodiment of the invention is a garment for wear by a human body having a localized fat accumulation. The garment includes a cover for at least a portion of the body and a body-heat inducer material substantially impermeable to perspiration. The body-heat inducer material and the cover, in combination, form a laminate. The garment also includes at least one boning segment of the laminate.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1B:
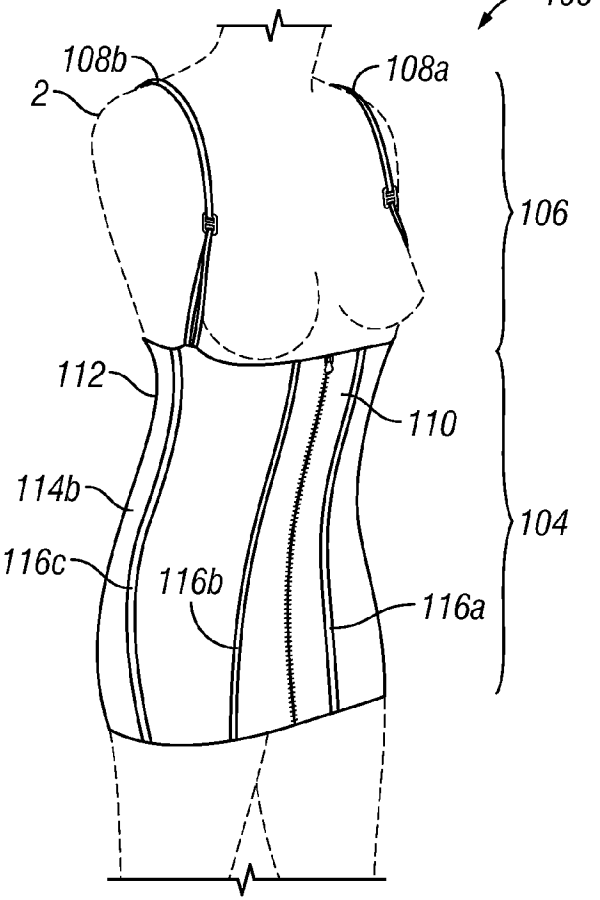
FIGS. 1A-C illustrate, respectively, a front view, a right side perspective view, and a back view of a figure moulding garment, including a wearer's body in phantom, according to certain embodiments of the invention.
Figure 1A:
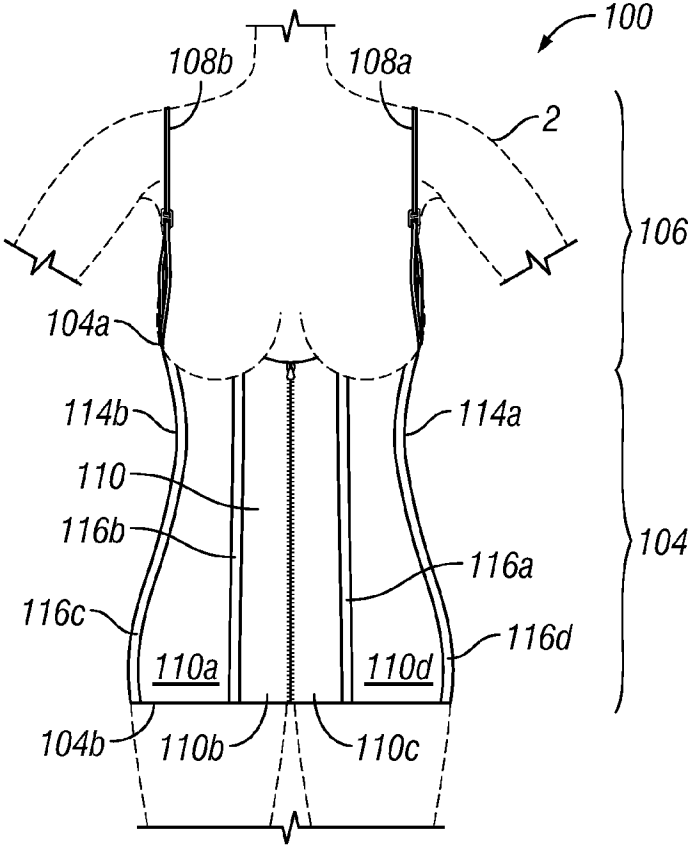
Figure 1C:
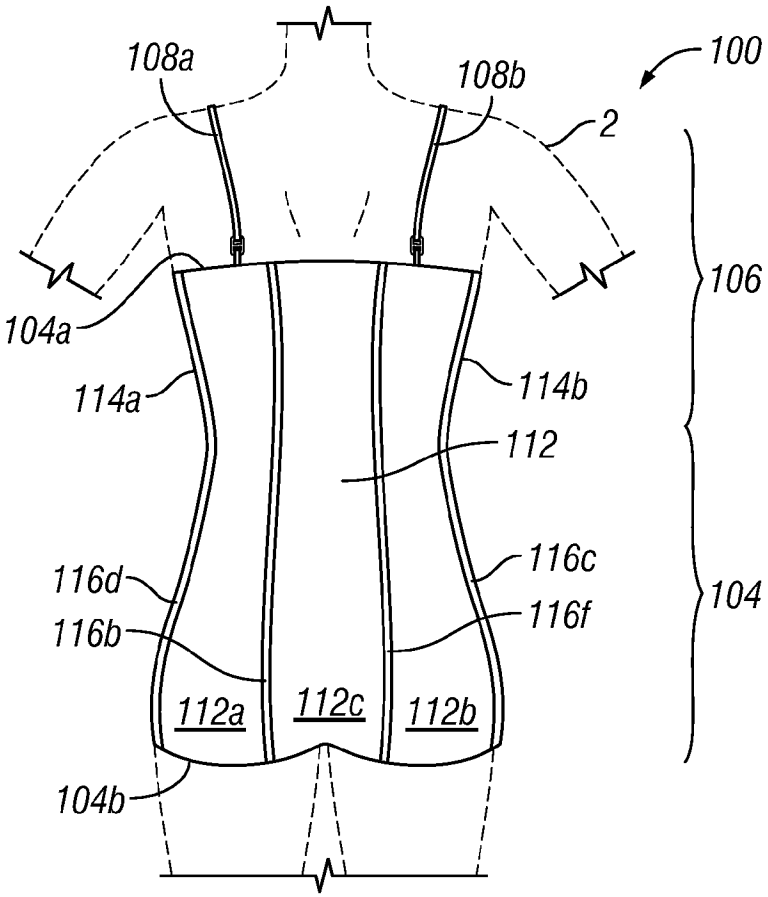

Referring to FIGS. 1A-C, a garment 100 for wear by a human body 2 (shown in phantom) includes a supportive portion 104 connected to an operative portion 106. When worn by the body 2 in use, the operative portion 106 contacts skin of the body 2 directly at locations of significant fat deposits and the supportive portion 104 retains the operative portion 106 to the body 2 at such locations. The supportive portion 104 permits relatively unrestricted freedom of movement of the body 2 during use, whereas the operative portion 6 compresses and supports the body 2 where in contact.

In the garment 100, the supportive portion 104 drapes shoulders of the body 2 and the operative portion 106 wraps the body 2 around its mid-section. The operative portion 106 is formed of polychloroprene (e.g., Neoprene™) layer or similar pliable, stretchably compressive, rubber-like material sheet having insulative and limited porosity/pemeability properties, without presenting any significant skin irritant or contact sensitizer. The polycholoroprene (or other similar material) forming the operative portion 106 may be foamed during manufacture with nitrogen or not, according to desired insulative characteristics. The supportive portion 104 is formed of a woven or open knit permeable fabric, for example, a woven fiber fabric such as polyurethane polymer fiber cloth (e.g., Spandex™ or Lycra™), or alternately woven polyester, cotton, silk or another permeable or absorbent fabric, or combinations, and may include adjustable clasps or attachments for varying length, size or dimensions to position and retain the operative portion 106 in select contact with the body 2 during wear of the garment 100

The supportive portion 104 supports and maintains the operative portion 106 in select location against the body 2 during wear of the garment 100, without significantly restricting movement, or compressing or binding the body 2, and is permeable to air and liquids, such as sweat (i.e., breathable). The operative portion 106 contacts skin, conforms to, and compresses the body 2 where in contact, during wear of the garment 100. The operative portion 106 retains heat of the body 2 where contacted and wrapped, and retains moisture from sweating of the body 2. The operative portion 106 also provides a compressive effect on the body 2 where so wrapped.

The operative portion 106, in certain embodiments of the foregoing, includes a front section 110 and a back section 112, connected at a left side seam 114*a* and at a right side seam 114*b* (in relation to the body 2) to form a somewhat tubular unit to accommodate and wrap the mid-section of the body 2. The operative portion 104 is sized to extend the front section 110 from about the sternum (just below breasts) to about the pelvic bone (or therebelow) of the body 2. The back section 112 of the operative portion is sized to extend from about the base of the shoulder blades to about the base of the buttocks of the body 2, uniformly relative to the front section 110 for continuous connection of the front section 110 and back section 112 along the side seams 114*a*, 114*b*. An example of the operative portion 106 is a layer sheet of Neoprene™, having a generally uniform thickness in the range of from about 0.25 mm to about 2.0 mm, for example 1.5 mm thickness. Alternately, other polychloroprenes, rubbers, and the like, including varieties in which elastane (e.g., Spandex™, Lycra™) or other synthetic fiber is mixed with neoprene in manufacture (i.e., so-called "super-flex" variety), as well as other or variations or varying thicknesses, are possible for forming the operative portion 106.

The operative portion 106 includes one or more boning segments 116 to provide postural and figure support and moulding to the body 2, in conjunction with compression effects of the operative portion 106. The boning segments 116 extend, for example, from a top extent (in the orientation of the Figures) to a bottom extent (in the orientation of the Figures) of the operative portion 106. Respective boning segments 116 are included in or fixed to, for example, the front 110, sides 114*a*, 114*b* and back 112. Each boning segment 116 is a plastic, nylon, polyester (e.g., polyester rods, such as Rigilene™) or steel (e.g., steel spiral), or other flexibly rigid length. According to certain embodiments, the operative portion 106 includes two boning segments 116*a*, 116*b* of the front section 110, two boning segments 116*f*, 116*e* of the back section 112, and two side boning segments 116*c*, 116*d* of the intersection of the front section 110 and back section 112 along the side seams 114*b*, 114*a*. Each respective boning segment 116*a*-116*f* is selected of width, length, rigidity, and other characteristic sufficient to provide postural and figure support and moulding to the body 2. An example of the boning segments 116*a*-116*f* is Rigilene™ boning material having length from top to bottom extent of the operative portion 6 at the location thereof, and having width in the range of from about one quarter (¼) inch to about three quarter (¾) inch, for example, one half (½) inch in width, although other boning materials and dimensions are possible as may be desired for support and moulding for particularities of the body 2 in any given circumstance.

The supportive portion 104 connects to the operative portion 106 at the front section 110 and the back section 112 to suspend the operative portion 106 in relation to the body 2 mid-section during wear. The supportive portion 104, for example, is straps 108*a*, 108*b*. The strap 108*a* is connected to the front section 110 towards the left side seam 114*b* and to the back section 112 also towards the left side seam 114*b*, in order to drape the left shoulder of the body 2 during wear. The strap 108*b* is connected to the front section 110 towards the right side seam 114*a* and to the back section 112 also towards the right side seam 114*a*, in order to drape the right shoulder of the body 2 during wear. The straps 108*a*, 108*b* can include adjustable fasteners 109*a*,109*b*, for example, clasps, buckles, buttons, hook and loop fastener (e.g., Velcro™), or others, for lengthening or shortening the straps 108*a*, 108*b* during wear of the garment 100, to suspend or otherwise retain the operative portion 106 in select contact to the mid-section of the body 2.

The straps 108*a*, 108*b* are formed of a permeable fabric, for example, polymer fiber or other woven fabric, which may but need not necessarily be a stretchable fabric. The supportive portion 104 effectively supports and maintains the operative portion 106 in select location against the body 2 during wear of the garment 100, but does not significantly restrict movement, compress, or bind the body 2 in areas covered by the supportive portion 104. The supportive portion 104 furthermore is permeable, allowing dissipation of sweat and heat of the body 2 where in contact to the supportive portion 104. An example of the strap 108*a* or 108*b* of the supportive portion 104 is one or more strap, lapel, strings or ties formed of a woven fiber fabric, such as Spandex™, Lycra™, Powernet™, or, alternately woven polyester, cotton, silk or other permeable or absorbent fabric, or combinations, and may include adjustable clasps or attachments for varying length, size or dimensions to position and retain the operative portion 6 in select contact with the body 2 during wear of the garment 100.

In use, the garment 100 is worn by the body 2, for example, the garment 100 is worn during exercise. The operative portion 106 is located at, and contacts skin at locations of fat tissue areas of the body 2, and wrappingly compresses the body 2 in those locations. The supportive portion 104 suspends or otherwise retains the garment 100 to the body 2, such that the operative portion 106 remains in contact with skin in fat tissue areas of the body 2. The operative portion 106, via its insulative and limited permeability properties, retains heat and encourages perspiration of the body 2 where in contact. The body heating and sweating can aid fat degradation in the specific areas contacted by the operative portion 106. The operative portion 106, in combination with the supportive portion 104, thus allows focused and select placement of insulative material of the operative portion 106 in specific body locations where fat accumulates in order to aid weight loss in those locations. The boning segments 116 of the operative portion 106, together with compressive effects of the material of the operative portion 106, support, shape and mould the body 2. The straps 108*a*,108*b* of the supportive portion 104 for suspending the operative portion 106 in select contact to the body 2, are locatable to allow unrestricted movement of upper body extensions, such as arms, breasts, neck and head.

In certain uses of the garment 100, an anticellulite agent is placed or spread on skin of the body 2 in areas of fat accumulation prior to dressing with the garment 100. This anticellulite agent is dispersed on skin of the body 2 in areas of fat accumulation for contact by the operative portion 106 during wear. The anticellulite agent is any of a wide variety of conventional gel, liquid, cream or other spreadable or applyable lotions, or combinations, and includes future anticellulitic agents for similar purpose and use. In certain alternatives, the anticellulite agent is included in a kit comprising the anticellulite agent and the garment 100. For example, a pad, wipe or sponge of pre-absorbed anticellulitic gel, liquid or cream is packaged as a unit. In the example, the pad, wipe or sponge is rubbed on the skin of the body 2, to spread the anticellulite agent, and during dressing, the operative portion 106 is placed in contact with the skin where rubbed and retained there by the supportive portion 104 during wear of the garment 100.

In certain alternatives, the front section 110 and back section 112 of the operative portion 104 are each formed of panels of polychloropropene material layer stitched or otherwise joined or connected along seams. For example, the front section 110 includes four panels 110*a-d*. The panel 110*a* extends from a top extent 104*a* to a bottom extent 104*b* of the front section 110. The panel 110*a* is connected at sides (for example, sewn) along the side seam 114*b* to the back section 112, and along one side of the panel 110*b* extending from the top extent 104*a* to the bottom extent 110*b* of the front section 110. Each seam between panels 110*a*, 110*b* and between panel 110*a* and the back section 112 accommodates and connects respective boning segments 116*b* or 116*c*. The panel 110*d* of the front section also extends between the top and bottom extents 104*a*,104*b*, and is connected at sides (for example, sewn) along the side seam 114*a* to the back section 112 and to one side of the panel 110*c*. The seam of panels 110*d* and 110*c* accommodates and connects the boning segment 116*a*, and the seam connecting the panel 110*d* to the back section 112 accommodates and connects the boning segment 116*d*. Sides of the panels 110*b* and 110*c* opposing the connecting seam to panels 110*a* and 110*d*, respectively, may include zipper, bottons, clasps, snaps, hook and loop, lacing, or other fastener device or devices to assist dressing and undressing and/or for adornment or ornamentation of the garment. The back section 112 is, for example, similarly formed of three panels 112*a-c*. Each panel 112*a-c* extends between the top and bottom extents 104*a*, 104*b* of the back section 112. One side of the panel 112*a* is connected at the side seam 114*a* to the front section 110, and the other side of the panel 112*a* is connected to one side of the panel 112*c*. One side of the panel 112*b* is connected at the side seam 114*b* to the front section 110, and the other side of the panel 112*b* is connected to the other side of the panel 112*c*.

Figure 2:
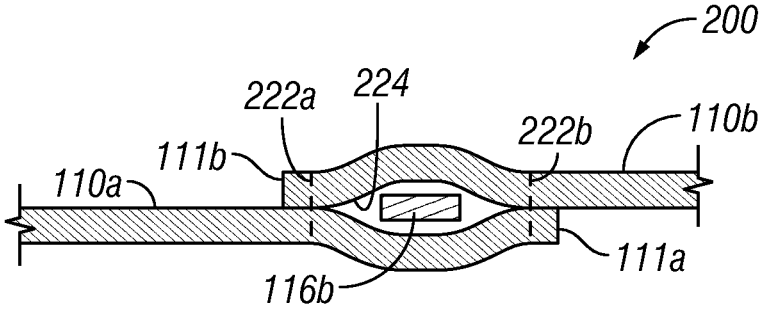
FIG. 2 illustrates a cross-section of a seam of a figure moulding garment, including a boning segment, according to certain embodiments of the invention.

Referring to FIG. 2, in conjunction with FIGS. 1A-C, an exemplary stitched seam 200 of the operative portion 106, according to certain embodiments, connects respective panels, for example, panels 110*a* and 110*b*, along the seam 200 extending between the top and bottom extents 104*a*, 104*b* of the operative portion 106. Sides of the respective panels are overlapped, for example panel 110*b* overlaps panel 110*a* to allow sufficient connection (for example, sewn) of a side extent 111*a* of the panel 110*a* to the panel 110*b*, and of a side extent 111*b* of the panel 110*b* to the panel 110*a*, forming a tube 224 between the panels 110*a*, 110*b* to accommodate the boning segment 116*b* lengthwise along the seam 200. The seam 200 is formed, for example, by respective stitch 222*a*, 222*b* extending from the top extent 104*a* to the bottom extent 104*b* of the panels 110*a*,110*b*, and separated (in cross-section of FIG. 2) sufficiently to accommodate the boning segment 116*b* between the stitches 222*a* and 222*b* and the panels 110*a* and 110*b* between the stitches 222*a* and 222*b*. In manufacture, the respective stitch 222*a* and 222*b* can be made in sequence either with or without the boning segment 116*b* in place in the tube 224. If the stitches 222*a* and 222*b* are not made while the boning segment 116*b* is located in the tube 224, the boning segment 116*b* is fitted into the tube 224 thereafter. The boning segment 116*b* may be retained in the tube 224 by tight fit or, alternately, sewn therein, retained therein by seams formed along the top and bottom extents 104*a*, 104*b* of the operative portion 106, or other suitable manner. The exemplary stitched seam 200 is replicated at each seam connecting panels 110*a-d*, 112*a-c*, in the operative portion 106 and respective boning segment at the seam.

Figure 3:
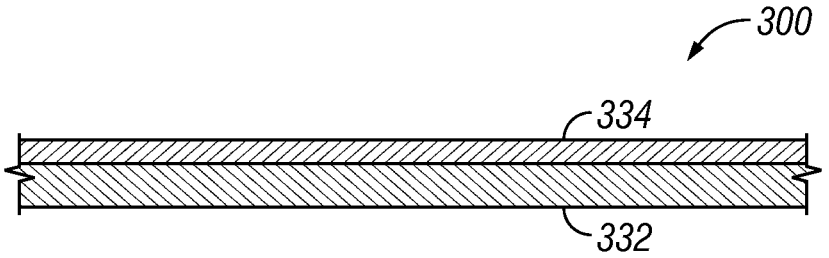
FIG. 3 illustrates a cross-section of a laminate of a figure moulding garment, the laminate includes a stretchable fiber fabric and a neoprene layer, according to embodiments of the invention.

Referring to FIG. 3, in conjunction with FIGS. 1A-C, the operative portion 106, according to certain embodiments, is formed of a laminated layer 300. The laminated layer 300 includes a polychloroproprene base layer 332 (i.e., Neoprene), in laminated connection with an overlying polyurethane polymer fiber layer 334 (i.e., Spandex). The base layer 332 and the overlying fiber layer 334 are united, such as by adhesive, glue, or other laminate manufacture process (for example, in certain alternatives, the overlying fiber layer 334 is incorporated in the surface of the base layer 332). Alternatively, the overlying fiber layer 334 is stitched atop the base layer 332 along seams (such as side seams 114*a*, 114*b* and seams between panels 110*a-d*, 112*a-c*) of the garment 100, or the like. The overlying fiber layer 334 provides ornamentation and adornment to the base layer 332, and additionally can aid compression effects of the garment 100 where the overlying fiber layer 334 is a stretchable fabric.

Figure 4:
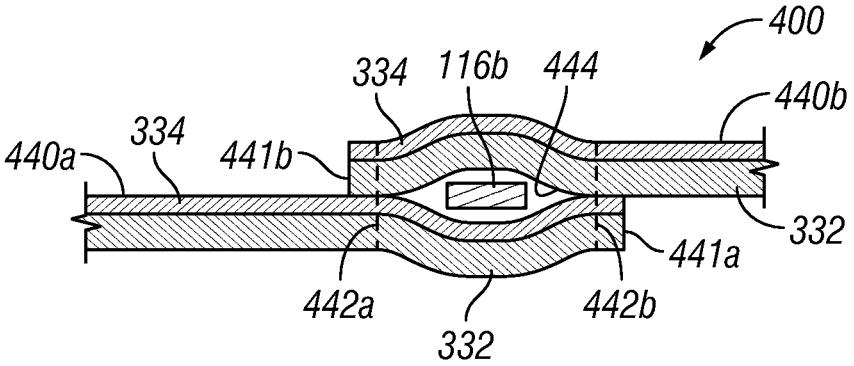
FIG. 4 illustrates a cross-section of an alternative seam of a figure moulding garment, including a boning segment, the seam formed by the laminate of FIG. 3, according to embodiments of the invention.

Referring to FIG. 4, in conjunction with FIGS. 1A-C and 3, an exemplary laminate seam 400 of the operative portion 106, according to certain embodiments in which the operative portion 106 is the laminated layer 300, connects respective panels forming the operative portion 106. For example, if the operative portion 106 is formed of the laminated layer 300, panels 440*a* and 440*b* replace the corresponding panels 110*a* and 110*b* in the garment 100. The seam 400 for the laminated layer 300 extends between the top and bottom extents 104*a*, 104*b* of the operative portion 106. Sides of the respective panels are overlapped, for example panel 440*b* overlaps panel 440*a* to allow sufficient connection (for example, sewn) of a side extent 441*a* of the panel 440*a* to the panel 440*b*, and of a side extent 441*b* of the panel 440*b* to the panel 440*a*, forming a tube 444 between the panels 440*a*, 440*b* to accommodate the boning segment 116*b* lengthwise along the seam 400. The seam 400 is formed, for example, by respective stitch 442*a*, 442*b* extending from the top extent 104*a* to the bottom extent 104*b* of the panels 440*a*,440*b*, and separated (in cross-section of FIG. 4) sufficient to accommodate the boning segment 116*b* between the stitches 424*a* and 424*b* and the panels 440*a* and 440*b* between the stitches 442*a* and 442*b*. Similar manufacture of the stitches 424*a*, 424*b*, tube 444 and accommodation of the boning segment 116*b* apply as has been described. In certain alternatives, as previously mentioned, the stitches 424*a*, 424*b* form the laminated layer 300 of each panel 440*a*, 440*b* where the overlying fiber layer 334 is not glued, adhered or otherwise fixed with the base layer 332 prior to connection of the panels 440*a*, 440*b*. The exemplary laminate seam 400 is replicated at each seam connecting panels 110*a-d*, 112*a-c*, in the operative portion 106 and respective boning segment at the seam.

Figure 5B:
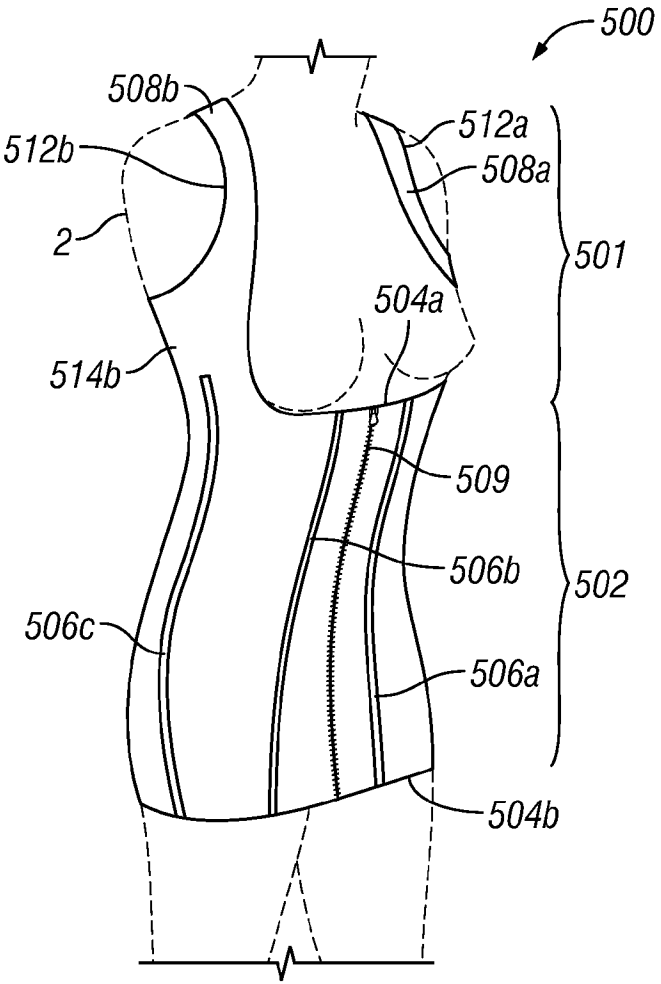
FIGS. 5A-C illustrate, respectively, a front view, a right side perspective view, and a back view of an alternative figure moulding garment, including a wearer's body in phantom, according to certain embodiments of the invention.
Figure 5A:
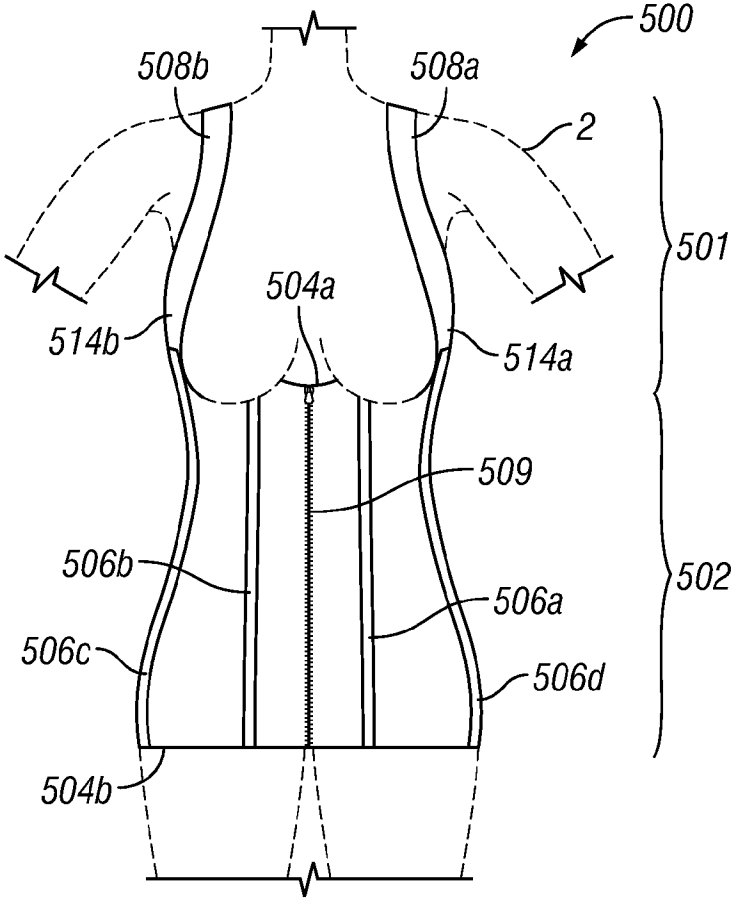
Figure 5C:
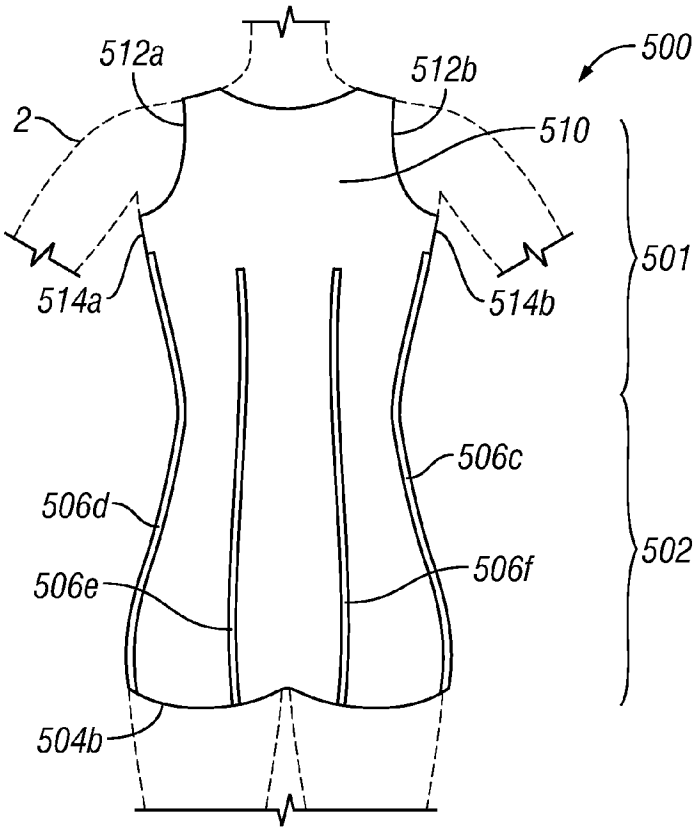

Referring to FIGS. 5A-C, an alternative garment 500 for wear by a body 2 (shown in phantom) is formed substantially entirely of polychloroprene (e.g., Neoprene™) layer and boning segments. In certain embodiments, the polychloroprene layer is included in a laminate fabric of the garment 500, such as the laminated layer 300 of FIG. 3. The polychoroprene layer (or laminate fabric, as applicable) of the garment 500 is a unitary piece or, alternately, if formed of connected panels (such as that previously described).

The garment includes a supportive portion 501 and a lower portion 502. The supportive portion 502 can, but need not necessarily, be a unitary extension of the lower portion 502. The supportive portion 501 and the lower portion 502 are each formed of polychoroprene material or the laminated layer 300 thereof, as desired. The lower portion 502 is fitted to extend at a top 504*a* thereof from just below the chest/breasts, to a bottom 504*b* thereof at about the pelvic bone (or therebelow) in front and about the base of the buttocks in back of the body 2. The lower portion 502 includes boning segments 506*a-f*, each extending from the bottom 504*b* to about the top 504*a*, and selectively located for postural and figural support and moulding in use. The lower portion 502 also includes a front facing closure 509, such as a zipper, extending from the top 504*a* to the bottom 504*b* in about the center front of the body 2. The closure 509 allows dressing during use to wrap the lower section 502 around the body 2 in close fit, and undressing to remove the garment 500.

The supportive portion 501 extends continuously from the lower portion at the front and back sides of the body 2. In the front, the supportive portion 501 forms straps 508*a* and 508*b* near respective sides of the body 2. The straps 508*a*, 508*b* loop shoulders of the body 2 during wear. In the back, the straps 508*a*, 508*b* intersect forming a shoulder cover 510 of the supportive portion 501. The shoulder cover 510 extends from the lower portion 502 to the neckline of the body 2 and between sleeveless arm holes 512*a*,512*b* for arms of the body 2 during wear. Underarm sides 514*a*,514*b* extend in the supportive portion 501, from the lower portion 502 to just under arms of the body 2.

In use during wear, the garment 500 provides support and compresses tissues in the shoulder blade areas of the back and underarm areas of the body 2. The lower portion 502 wraps, conforms to, and compresses the body 2 where wrapped, in manner similar to that of the operative portion of the garment 100 of FIGS. 1A-C. Boning segments 506*a-f* of the lower portion 502, together with compressive effects of materials of the lower portion 502, support, shape and mould the body 2. The supportive portion 501 supports and maintains the garment 500 in select location against the body 2 during wear. The garment 500 insulates and retains perspiration of the body 2 where in contact. For example, the garment 500, in addition to effects similar to those of the garment 100 of FIGS. 1A-C, provides additional compression and support in the upper body in side areas of underarms and across the upper back, as well as promotes heat and perspiration in these areas of the body 2 to aid weight loss in the locations.

Figure 6A:
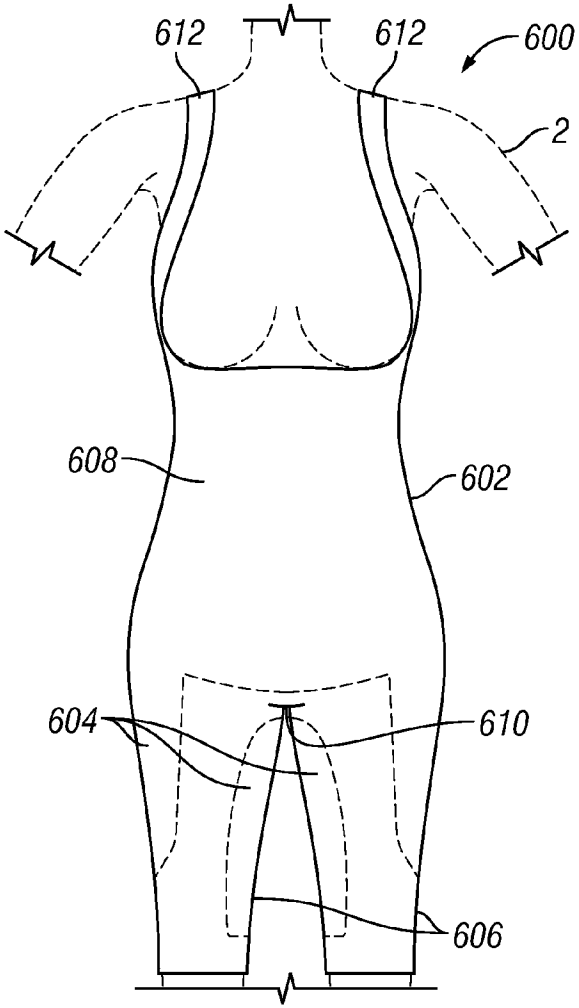
FIGS. 6A-C illustrate, respectively, a front view, a back view, and a right side perspective view of a jumper garment, including a wearer's body torso in phantom, according to certain embodiments of the invention.
Figure 6C:
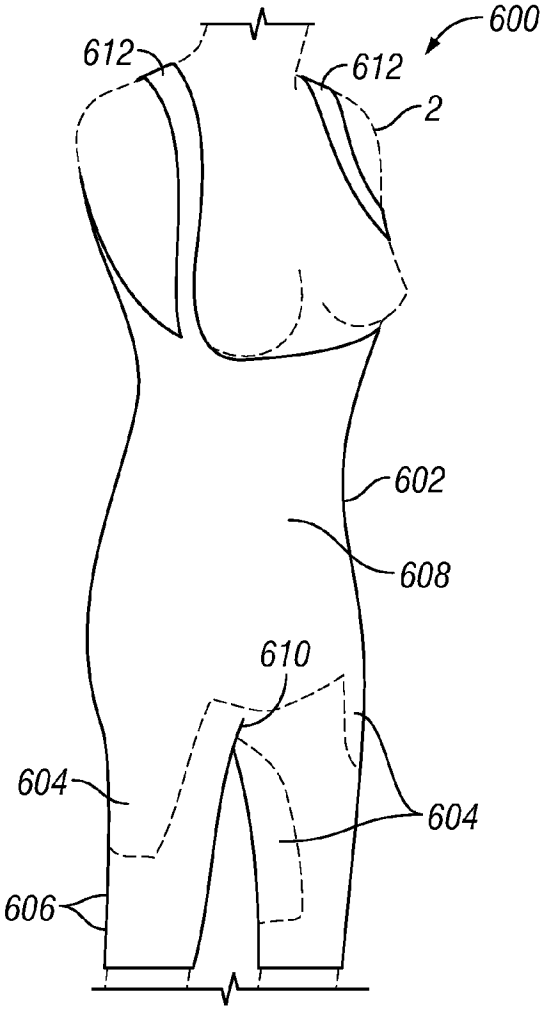
Figure 6B:
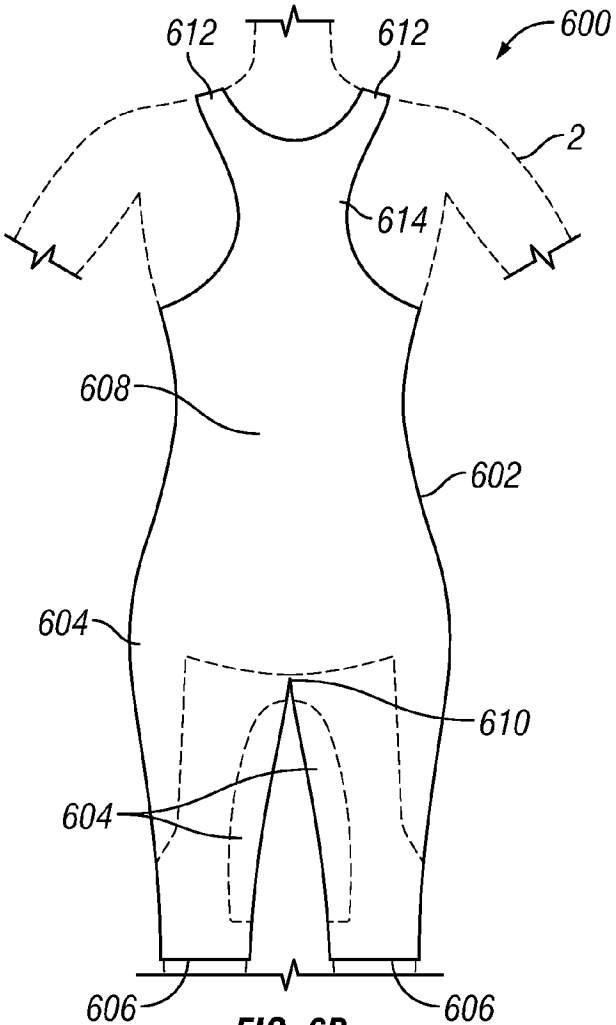

Referring to FIGS. 6A-6C, a jumper garment 600 is formed of an outerwear 602 lined on select portions by an operative layer 604 (shown in phantom) to be worn adjacent the body 2 in those lined areas. The outerwear 602 is formed as a unitary clothing, with just below-the-knee legs 606, a mid-section 608 extending from the legs 606 to form a crotch 610 and wrapping the abdomen below the chest/breasts in front and buttocks and back, and straps 612 extending from the mid-section 608 in front to drape shoulders and intersecting in a T-shaped shoulder portion 614 in back of the mid-section 608. The operative layer 604 lines the outerwear 602, in order to contact skin of the body 2 during wear, in select locations of fat accumulation of the body 2. For example, the operative layer 604 lines the outerwear 602 in the belly, inner and outer thigh, and back. In alternatives, the operative layer 604 is one or more respective panel, for example, three separate panels in FIGS. 6A-C. Each panel of the operative layer 604 is sewn at edges, or otherwise connected, laminated or affixed, to an inner side (i.e., wearer side) of the outerwear 602. Dimensions and shapes of the respective one or more panels are determined for select coverage of fat areas of the body 2. The panels, or respective ones of them as applicable, are located in attachment as lining of the outerwear 602 directly at locations of the outerwear 602 covering fat of the body 2 during wear.

The outerwear 602 is formed of an open knit woven fiber fabric, such as plyurethane polymer fiber cloth (e.g., Lycra), or alternately of woven polyester, cotton or another permeable or wicking fabric, or combinations. The outerwear 602 is manufactured by sewing along seams, or otherwise as will be understood, according to patterns providing for the legs, mid-section and straps. Panels of the operative layer 604 are each formed of polychloroprene (e.g., Neoprene) or other pliable, stretchably compressive open or closed cell rubber or rubber-like material that is insulative and substantially moisture impermeable. Panels of the operative layer 604 are cut to size for fat areas of the body 2, and fixed as lining of the outerwear 602 according to location of the body 2 of those fat areas.

In operation during wear, the outerwear 602 is placed on the body 2 by extending legs of the body 2 into the legs of the outerwear 602, abdomen of the body 2 in the mid-section of the outerwear 602 and the straps of the outerwear 602 over shoulders of the body 2. The panels of operative layer 604, because fixed as lining of the outerwear 602 in fat locations of the body, are thereby located in select and direct contact to skin of the body 2 in the fat areas. The operative layer 604 remains in such contact during wear, and promotes heat insulative and perspiration retentive effects of the body 2 in fat locations of the operative layer 604. The outerwear 602, on the other hand, allows heat and moisture dissipation from the body 2 because of the porous and breathable materials of the outerwear 602.

Figure 7B:
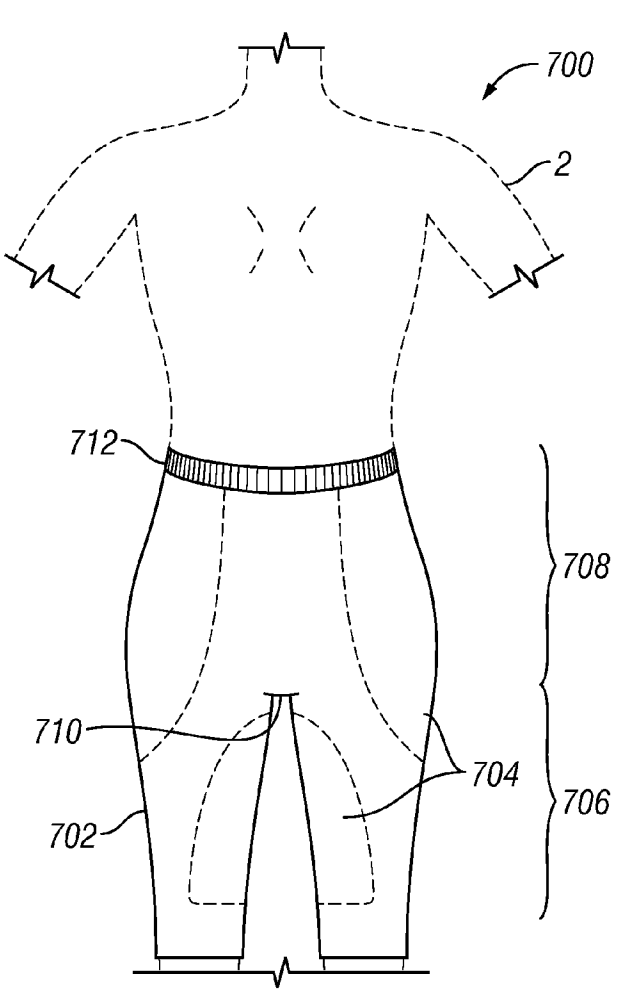
FIGS. 7A-C illustrate, respectively, a front view, a back view, and a right side perspective view of a short pants garment, including a wearer's body torso in phantom, according to certain embodiments of the invention.
Figure 7A:
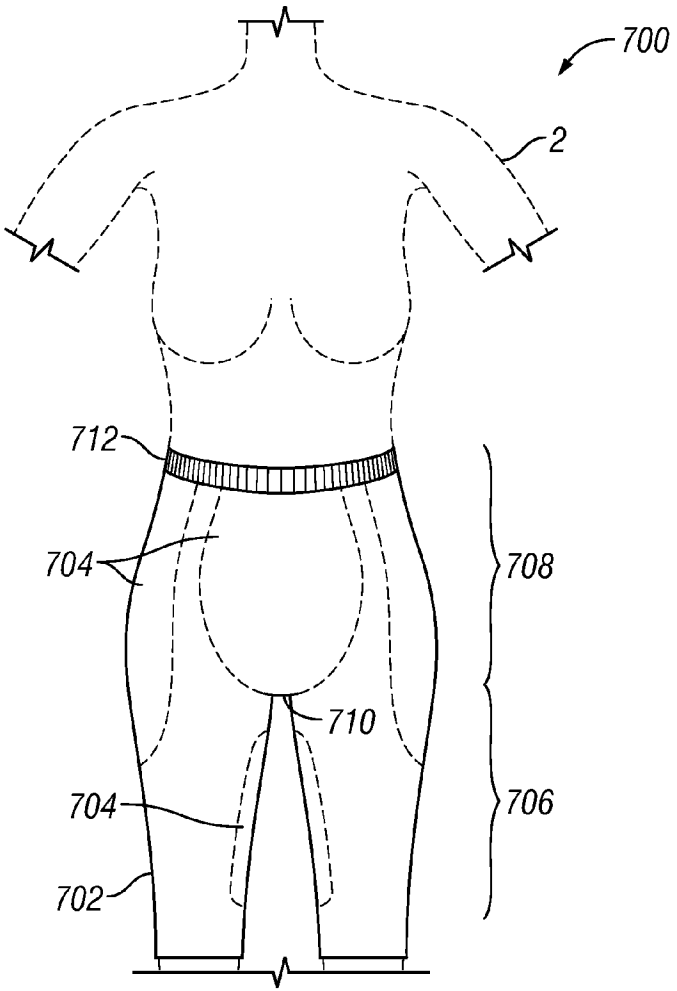
Figure 7C:
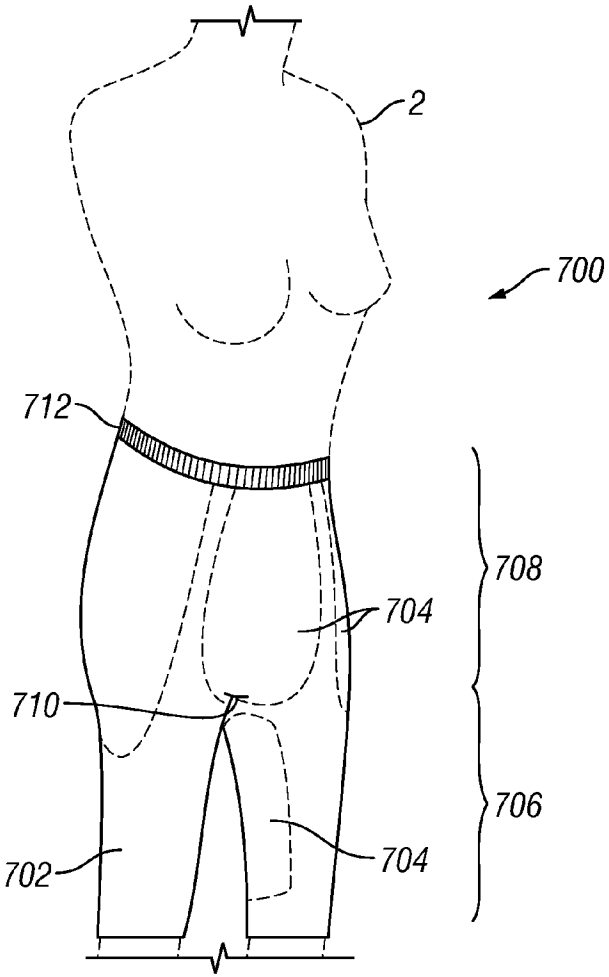

Referring to FIGS. 7A-C, a shorts garment 700 is formed of an outerwear short pants 702 lined on select portions by an operative layer 704 (shown in phantom) to be worn adjacent the body 2 in those lined areas. The short pants 702 is formed as a unitary clothing, with just below-the-knee legs 706 forming a crotch 710, and extending to a lower belly section 708 wrapping the lower abdomen of the body 2 below the waist. A waistband 712 is formed of the upper extent (in the Figures) of the short pants 702. The waistband 712 is, for example, an elastic band or gather combined in a folded seam of the short pants 702 along the upper extent thereof.

The operative layer 704 lines the short pants 702, in order to contact skin of the body 2 during wear, in select locations of fat accumulation of the body 2 covered by the short pants 702 during wear. For example, the operative layer 704 lines the short pants 702 in the lower belly to pubic bone region, inner thigh regions, and hip and upper outer thigh regions. The operative layer 704 is, for example, one or more respective panel, for example, five separate panels in FIGS. 7A-C. Each panel of the operative layer 704 is sewn at edges, or otherwise connected, laminated or affixed, to an inner side (i.e., wearer side) of the short pants 702. Dimensions and shapes of the respective one or more panels are determined for select coverage of fat areas of the body 2 in locations covered by the short pants 702 during wear. The panels, or respective ones of them as applicable, are located in attachment as lining of the short pants 702 directly at locations of the short pants 702 covering fat of the body 2.

The short pants 702 is formed of an open knit woven fiber fabric, such as plyurethane polymer fiber cloth (e.g., Lycra), or alternately of woven polyester, cotton or another permeable or wicking fabric, or combinations. The short pants 702 is manufactured by sewing along seams, or otherwise as will be understood, and the waistband 712 is formed as a gathered stretchable portion of the short pants 702 and may include elastic band or strip, draw string or cord, or similar retainers to fit and secure the short pants 702 on the body 2 at the waist. Panels of the operative layer 704 are each formed of polychloroprene (e.g., Neoprene) or, alternately, other pliable, stretchably compressive open or closed cell rubber or rubber-like material that is insulative and substantially moisture impermeable. These panels of the operative layer 704 are formed of size to cover fat areas of the body 2 and fixed as lining of the short pants 702 in select location for contact of fat areas of the body 2 during wear of the short pants 702.

In operation during wear, the short pants 702 is placed on the body 2 by extending legs of the body 2 into the legs 706 of the short pants 702 and enveloping below the waist of the body 2 (including the lower belly, hips and buttocks of the body 2) in the belly section 708 such that the waistband 712 resides at the waist of the body 2. The waistband 712 elastically compresses the body 2 at the waist or, alternatively, if the waistband 712 is provided with draw cord or other similar device for securement, is tied to cinch the body 2 at the waist. The panels of operative layer 704, because fixed as lining of the short pants 702 in select location, are thereby located during wear of the short pants 702 in direct contact to skin of the body 2 in fat areas. For example, the panels of the operative layer 704 may contact and cover inner thighs, lower belly/pubic bone, and hips/outer thighs areas. The operative layer 704 contacts the body 2 in these locations during wear, promoting heat and perspiration in the locations because the operative layer 704 is insulative and substantially impermeable to moisture in the locations. The short pants 602 in areas not lined by the operative layer 704, are porous and dissipate heat and perspiration.

Figure 8B:
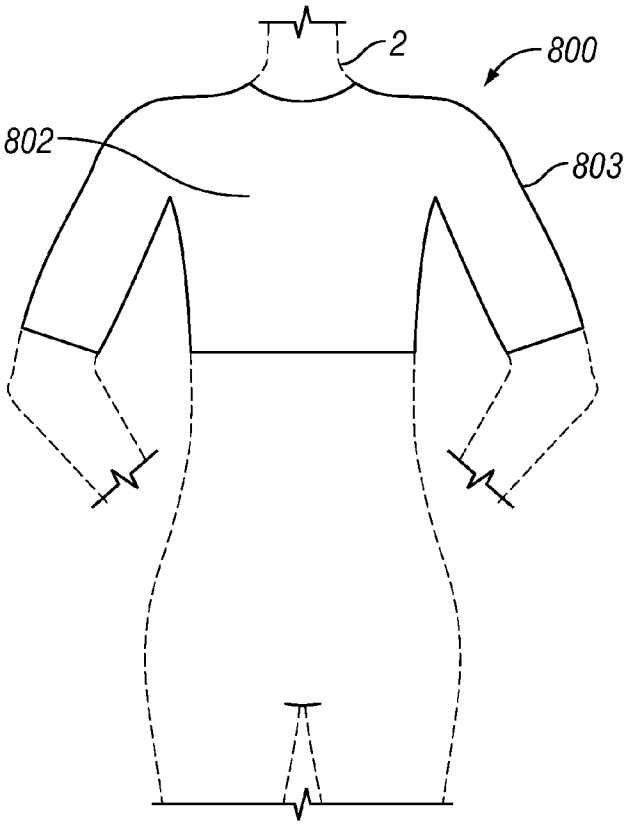
FIGS. 8A-B illustrate, respectively, a front view and a back view, of a short "bolero" jacket garment, including a wearer's body torso in phantom, according to certain embodiments of the invention.
Figure 8A:
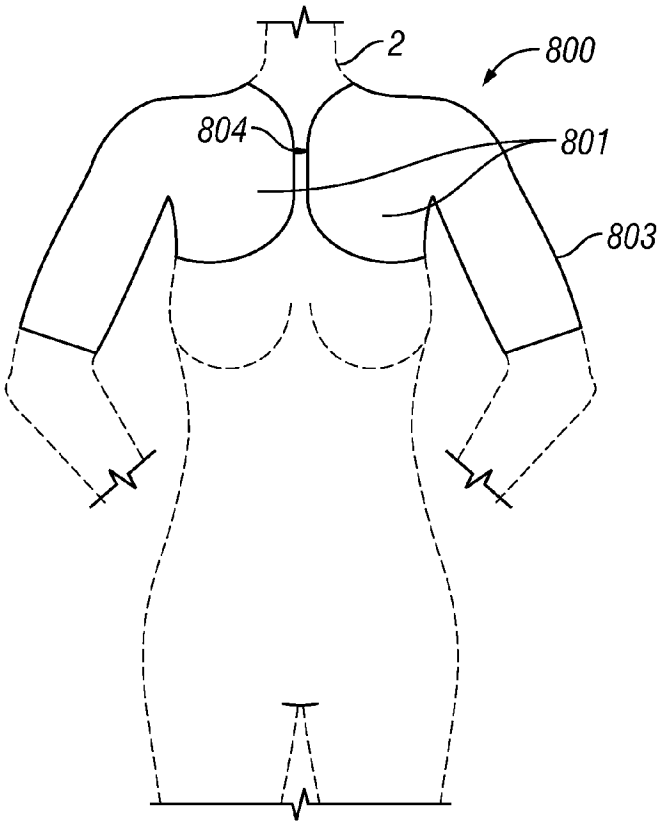

Referring to FIGS. 8A-B, an alternative "bolero" garment 800 for wear by a body 2 (shown in phantom) is formed substantially entirely of polychloroprene (e.g., Neoprene™) layer. In certain embodiments, the polychloroprene layer is included in a laminate fabric of the garment 500, such as the laminated layer 300 of FIG. 3. The polychoroprene layer (or laminate fabric, as applicable) of the garment 500 is a unitary piece or, alternately, is formed of connected panels (in similar manner to that previously described with respect to other embodiments).

The garment 800 includes two front-half portions 801, a back portion 802, and sleeves 803. The two front portions 801, the back portion 802, and sleeves 803 are each formed of polychoroprene material or the laminated layer 300 thereof, or certain of the portions 801,802,803, but not all, are formed with different ones of these or combinations of these and other materials. The two front-half portions 801 are fitted to commence at the shoulder at the neckline extending to just above the chest/breasts on respective left and right front sides of the body 2. The back portion 802 connects to the respective front-half portion 801 forming a neck opening for the body, for example, the front-half portions 801 connect at the top of the respective shoulders of the body 2 to the back portion 802. The back portion 802 extends from the neckline of the back side of the body 2, and across the upper back below the shoulder blades of the body, to connect the respective front-half portions of the right and left shoulders forming armholes therethrough for the body 2. One of the sleeves 803 is connected to the front portion 801 and the back portion 802 forming the armhole, to one arm of the body 2 to extend through the armhole and reside within the sleeve 803; and the other of the sleeves 803 is connected to the front portion 801 and the back portion 802 forming the other armhole, to accommodate the other arm of the body 2 extending through the armhole and residing in the sleeve 803. The sleeves 803 each form tubular extensions from the respective armholes to just above respective elbows of the body 2.

The two front portions 801 also include a closure device 804, such as ties, zipper, botton(s)/buttonhole(s), clasps, snaps, hook and loop, lacing, or other fastener device or devices, for selective connection of the front-half portions 801 to assist dressing, undressing, and retention of the garment 800 to the body 2 during wear. The closure device 804 can additionally, but need not necessarily, provide adornment or ornamentation in the garment 800. The closure device 804, when the front-half portions 801 are not connected and during dressing the body 2, allows the body 2 to place (or remove if undressing) one arm through a corresponding armhole and sleeve, with the back portion 802 oriented across the upper back, and to place (or remove) the other arm through the other corresponding armhole and sleeve. During wear, the closure device 804 is selectively engaged connecting the front-half portions 801 to retain the garment 800 to the body 2, with each arm respectively located in one of the sleeve 803, the back portion 802 extending across and contacting the upper back from the neckline to base of the shoulder blades of the body 2, and the front-half portions 801 extending across portions of the body 2 above and adjacent the breasts/chest.

In use during wear, the garment 800 provides support and compresses tissues in the shoulder blade areas of the back and underarm areas of the body 2. The front portion 801 wraps, conforms to, and compresses the body 2 where wrapped. The garment 800 insulates and retains perspiration of the body 2 where in contact. For example, the garment 800 provides additional compression and support in the upper body in side areas of underarms and across the upper back, as well as promotes heat and perspiration in these areas of the body 2 to aid weight loss in the locations.

In the foregoing embodiments, various alternatives are possible. Other clothing designs, which are comprised of Neoprene or other similarly insulative and impermeable operative layers or materials, are possible to aid weight loss and provide same heat and perspiration effects in a wide variety of body fat location. For example, sleeves, or portions of sleeves, comprised of such operative layers and materials, can be included in clothing for contact to undersides of upper arms or the like. In other examples, fat locations in male bodies may differ from those typical in female bodies, and operative layers or materials may alternately be located primarily in the gut and similar areas of the male body as lining or as entirety of male clothing. All alternatives of decoration and adornment may be included in the garments according to the foregoing, for example, lace, frills, appointments, bows, sequins, beads, buttons, colors, and the like, can make the garments more attractive and appealing to encourage and promote wear to achieve intended effects.

In alternatives, the foregoing garment embodiments can be used with or without additional weight loss and figure moulding and shaping aids. For example, anticellulite agent may be applied to skin in fat locations for contact to the operative layer and materials of the garments. An anticellulite wipe, as has been described, is particularly desirable for such application and use with the garments, and any of them. Kits including garment and such wipes are expressly included as alternatives. Additionally, other wiped or applied agent or substance may be possible. For example, in certain alternatives, a heat inducing agent, such as a muscle relaxant, anti-arthritic, pain relief, or similar agent, may be used in conjunction with the garment. These agents may include menthol, camphor, methyl salicylate, capsaicin, and other similar components, in gel, cream, liquid or similar form.

Attached as Appendix A and incorporated in this specification are certain additional disclosure, and alternatives and examples, according to embodiments.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems and device(s), connection(s) and element(s) that may cause any benefit, advantage, or solution to occur or become more pronounced are not to be construed as a critical, required, or essential feature or element of any or all the claims. As used herein, the terms "comprises, "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A garment for wear by a human body having a localized fat accumulation, comprising:

a boning segment for supporting and shaping the body during wear;

an insulative and perspiration impermeable first panel;

an insulative and perspiration impermeable second panel, an edge of the second panel overlaps an edge of the first panel;

a first row of stitches connected to the second panel and the first panel, in combination, near the edge of the first panel;

a second row of stitches connected to the first panel and the second panel, in combination, near the edge of the second panel;

wherein the first row of stitches and the second row of stitches form a tube bounded by the first panel and the second panel between the first row of stitches and the second row of stitches, and the tube is sized to accommodate accommodate the boning segment in the tube;

wherein the first panel and the second panel, as connected in combination by the first row of stitches and the second row of stitches, are sized to conform to the localized fat accumulation; and a supportive cover connected at least in part to the first panel and the second panel to form a laminate, for retaining the first panel and the second panel, in combination, in contact to the localized fat accumulation during wear.

2. The garment of claim 1, wherein the first panel is formed of polychloroprene.

3. The garment of claim 2, wherein the supportive cover is formed of a stretchable fabric, and the first panel and the second panel, in conjunction with the supportive cover and the boning segment, compress the localized fat accumulation and shape and mould the body where covered by any of the supportive cover, the first panel, the second panel, and the supportive cover and the first panel and the second panel in combination, during wear.

4. The garment of claim 3, wherein the boning segment is formed of any of plastic, nylon, polyester, woven polyester rods, steel, and combinations of these.

5. The garment of claim 4, wherein the supportive cover is formed of an open knit synthetic fiber fabric.

6. A garment for wear by a human body during exercise, comprising:

an operative portion of neoprene layer, wrappingly contacting the abdomen below the breasts and extending to at least the pubic bone of the body and the back below the shoulder blades and extending to at least the base of the buttocks of the body during wear, the operative portion includes at least two panels connected by respective rows of stitches to form a respective tube between the rows connecting adjacent ones of the at least two panels;

a supportive portion connected to the operative portion, draping shoulders of the body during wear to selectively retain the operative portion contacting the body; and at least one boning segment, respectively, retained in the respective tube, in connection to the operative portion, each of the at least one boning segment extending from either of (i) below the breasts to at least the pubic bone of the body in connection to the operative portion, and (ii) below the shoulder blades to at least the buttocks of the body in connection to the operative portion.

7. A corset for wear by a human body, comprising:

a neoprene tube sized to wrap the body, in contact around the lower torso of the body, the neoprene tube is formed of at least two neoprene panels, each of the at least two neoprene panels is connected to adjacent ones of the at least two neoprene panels by two rows of stitching forming a respective boning tube between adjacent ones of the panels;

at least one boning segment, one boning segment is maintained in each respective boning tube and thereby connected to the neoprene tube extending longitudinally along the neoprene tube within the respective boning tube; and a strap connected to the neoprene tube, sized to retain the neoprene tube suspended in contact with lower torso of the body.

8. A garment for wear by a human body having a localized fat accumulation, comprising:

a cover for at least a portion of the body;

a body-heat inducer material, substantially impermeable to perspiration, the cover is laminated in connection to the body-heat inducer material;

a first edge of the cover and the body-heat material, as laminated;

a second edge of the cover and the body-heat material, as laminated;

a first seam joining the first edge and the second edge in overlapping engagement, the first seam is near the first edge and adjacent the second edge;

a second seam joining the second edge and the first edge in overlapping engagement, the second seam is near the second edge and adjacent the first edge;

wherein the first edge, the second edge, the first seam and the second seam forming a tube between the first seam and the second seam and bounded by the first edge and the second edge; and at least one boning segment contained within the tube formed between the first seam and the second seam and between by the first edge and the second edge.

* * * * *